US010256518B2

(12) United States Patent
Hendry et al.

(10) Patent No.: US 10,256,518 B2
(45) Date of Patent: Apr. 9, 2019

(54) DRILL TUNING OF APERTURE COUPLING

(71) Applicant: Nokia Solutions and Networks Oy, Espoo (FI)

(72) Inventors: David R Hendry, Auchenflower (AU); Steven J Cooper, Moorooka (AU); Chris Boyle, Brisbane (AU); Brian Hurley, The Gap (AU)

(73) Assignee: Nokia Solutions and Networks Oy, Espoo (FI)

( * ) Notice: Subject to any disclaimer, the term of this patent is extended or adjusted under 35 U.S.C. 154(b) by 144 days.

(21) Appl. No.: 15/408,837

(22) Filed: Jan. 18, 2017

(65) Prior Publication Data

US 2018/0205126 A1 Jul. 19, 2018

(51) Int. Cl.
*H01P 1/208* (2006.01)
*H01P 7/10* (2006.01)
(Continued)

(52) U.S. Cl.
CPC ..... *H01P 1/2084* (2013.01); *H01P 1/2002* (2013.01); *H01P 1/208* (2013.01); *H01P 7/10* (2013.01); *H01P 11/006* (2013.01)

(58) Field of Classification Search
CPC ..... H01P 1/2002; H01P 1/2084; H01P 7/10; H01P 11/006
(Continued)

(56) References Cited

U.S. PATENT DOCUMENTS 3,657,670 A 4/1972 Kitazume et al.
4,879,533 A 11/1989 de Muro et al.
(Continued)

FOREIGN PATENT DOCUMENTS

JP 2002135003 A 5/2002

OTHER PUBLICATIONS

Dupont, "Properties Handbook", Dupont, p. 4 (30 pgs.), Nov. 2003.
(Continued)

*Primary Examiner* — Rakesh B Patel
(74) *Attorney, Agent, or Firm* — Harrington & Smith

(57) ABSTRACT

A pair of joined dielectric resonator components of an RF filter includes a first dielectric resonator component and a second dielectric resonator component. The first dielectric resonator component includes a first block of dielectric material, which has a coating of a first conductive material and at least one planar face. The at least one planar face includes a first aperture formed by removing the coating of first conductive material from a portion of the planar face of the first block. The second dielectric resonator component includes a second block of dielectric material, which has a coating of a second conductive material and at least one planar face. The at least one planar face includes a second aperture formed by removing the coating of second conductive material from a portion of the planar face of the second block. The first and second dielectric resonator components are joined to one another with the coating of first conductive material on the planar face of the first block in contact with the coating of second conductive material on the planar face of the second block, and with the first aperture aligned with the second aperture. The second dielectric resonator component has a hole through the coating of second conductive material and into the second block of dielectric material. The hole is outside of the second aperture, and controls electric-field coupling between the first and second dielectric resonator components.

23 Claims, 14 Drawing Sheets

(51) Int. Cl.
*H01P 1/20* (2006.01)
*H01P 11/00* (2006.01)

(58) Field of Classification Search
USPC ..... 333/208, 209, 212, 219, 219.1
See application file for complete search history.

(56) References Cited

U.S. PATENT DOCUMENTS

| | | | | |
|---|---|---|---|---|
| 4,963,844 | A | 10/1990 | Konishi et al. | |
| 5,023,866 | A | 6/1991 | De Muro | |
| 5,307,036 | A | 4/1994 | Turunen et al. | |
| 5,325,077 | A | 6/1994 | Ishikawa et al. | |
| 5,731,751 | A | 3/1998 | Vangala | |
| 6,002,307 | A | 12/1999 | Arakawa | |
| 6,016,091 | A | 1/2000 | Hidaka et al. | |
| 6,025,291 | A | 2/2000 | Murakawa | |
| 6,133,808 | A | 10/2000 | Arakawa | |
| 6,160,463 | A | 12/2000 | Arakawa et al. | |
| 6,346,867 | B2 | 2/2002 | Arakawa et al. | |
| 6,549,094 | B2 | 4/2003 | Takagi et al. | |
| 6,677,837 | B2 | 1/2004 | Kojima et al. | |
| 6,762,658 | B1 | 7/2004 | Isomura et al. | |
| 6,825,740 | B2 | 11/2004 | Kundu | |
| 7,042,314 | B2 | 5/2006 | Wang et al. | |
| 8,325,077 | B2 | 12/2012 | Gentric | |
| 2001/0000429 | A1 | 4/2001 | Arakawa et al. | 333/208 |
| 2001/0024147 | A1 | 9/2001 | Arakawa et al. | 333/135 |
| 2002/0024410 | A1 | 2/2002 | Guglielmi et al. | 333/202 |
| 2002/0039058 | A1 | 4/2002 | Sano et al. | 333/202 |
| 2003/0006864 | A1 | 1/2003 | Hattori et al. | 333/202 |
| 2003/0090344 | A1 | 5/2003 | Wang et al. | 333/202 |
| 2003/0227360 | A1 | 12/2003 | Kirihara et al. | 333/239 |
| 2004/0056736 | A1 | 3/2004 | Enokihara et al. | 333/202 |
| 2005/0128031 | A1 | 6/2005 | Wilber et al. | 333/202 |
| 2005/0140474 | A1 | 6/2005 | Kim et al. | 333/219.1 |
| 2005/0253672 | A1 | 11/2005 | Enokihara et al. | 333/219.1 |
| 2006/0139127 | A1 | 6/2006 | Wada et al. | 333/202 |
| 2008/0018391 | A1 | 1/2008 | Bates | 327/557 |
| 2008/0211601 | A1 | 9/2008 | Bates | 333/186 |
| 2014/0077900 | A1 | 3/2014 | Rogozine et al. | 333/212 |
| 2015/0180103 | A1 | 6/2015 | Hendry et al. | |
| 2016/0099492 | A1 | 4/2016 | Yuan et al. | |

OTHER PUBLICATIONS

Yoa H-W et al Quarter Wavelength Ceramic Combline Filters; 1996; IEEE Transactions on Microwave Theory and Techniques; vol. 44, No. 12.

DRILL TUNING OF APERTURE COUPLING

TECHNICAL FIELD

This invention relates generally to filter components and, more specifically, relates to a method for the tuning of filter components.

BACKGROUND

This section is intended to provide a background or context for the invention to be disclosed below. The description to follow may include concepts that could be pursued, but have not necessarily been previously conceived, implemented or described. Therefore, unless otherwise explicitly indicated below, what is described in this section is not prior art to the description in this application and is not admitted to be prior art by inclusion in this section.

A filter is composed of a number of resonating structures and energy coupling structures which are arranged to exchange radio-frequency (RF) energy among themselves and input and output ports. The pattern of interconnection of these resonators to one another and to the input and output ports, the strength of these interconnections, and the resonant frequencies of the resonators determine the response of the filter.

During the design process for a filter, the arrangement of the parts, the materials from which the parts are made, and the precise dimensions of the parts are determined such that an ideal filter so composed will perform the desired filtering function. If a physical filter conforming exactly to this design could be manufactured, the filter would perform exactly as intended by the designer.

However, in practice, the precision and accuracy of manufacture of both the materials and the parts are limited, and results in errors in resonant frequencies and coupling strengths, which, in turn, cause the filter response to differ from that predicted by an ideal filter model. Often, this departure from the ideal response is sufficiently large to bring the filter outside of its design specification. Because of this, it is desirable to include in the filter design some means for adjusting the resonator frequencies and coupling strengths to bring the filter response within the design specification.

A common means for accomplishing this is to include, in or on the filter, tuning screws or other devices, which are well known in the art. An alternative means often used with small ceramic monoblock filters is to remove selected portions of the metallization from their exteriors, and possibly portions of ceramic as well, to perform the tuning.

Most filters are manufactured as completed units and, subsequent to their manufacture, the tuning procedure is performed on the entire filter. Since various adjustments on the filter may interact strongly with one another, the tuning procedure is often quite complicated, and requires a skilled operator.

An alternative tuning method is to build the filter parts separately, to tune them individually to a specification calculated for the separate parts from the ideal filter model, and finally to assemble them to form the filter. Since the individual parts are simple compared with the fully assembled filter, the tuning procedure for the individual parts can also be made very simple. This minimizes the need for skilled operators to tune the filters. Such a procedure also provides the benefit of either reducing or entirely eliminating the tuning process for the assembled filter.

In many cases, it is sufficient only to adjust the resonant frequencies of the resonator parts, because the manufacturing precision and accuracy for the resonator parts are good enough to bring the coupling strengths within the range required to enable the performance of the assembled filter to be within specification. In such cases, adjustment of the resonant frequencies is all that is required to tune the individual parts. In other cases, the manufacturing precision and accuracy is insufficient to bring the coupling strengths within the required range, and so the couplings between the individual parts must also be adjusted to bring the assembled filter within specification.

To facilitate pretuning of the frequencies of the individual parts, both methods of measurement of the frequencies and methods of adjustment of the frequencies are required. Likewise, to allow pretuning of the couplings between adjacent parts, both methods of measurement of the couplings and methods of adjustment of the couplings are required.

In a filter constructed from separate resonator parts joined together, the coupling between adjacent resonator parts often takes the form of a coupling structure shared between the adjacent parts. In order to measure the coupling strengths between the resonator parts, it is necessary, prior to the measurement, to bring them together either as the entire set of parts so as to assemble the entire filter, as a subset of parts so as to assemble only part of the filter, or as a pair of adjacent parts between which is the coupling strength to be adjusted. In order to adjust the coupling strengths, some procedure for modifying the coupling structure or some sort of tuning structure must be present, either as an explicit feature of the coupling structure, or as an additional structure which can be added to the coupling structure as part of the tuning process.

A tuning method for either frequencies or coupling strengths may include the manipulation of a tuning device or structure included as part of the resonator or coupling structure, such as a tuning screw or deformable metal part. Alternatively, a method may comprise an operation performed on the resonator or coupling structure, such as the removal of material from a selected region, or the addition of material to a selected region. The method may also comprise a combination of these, or any other means or process which can alter the resonant frequencies of the resonator part or which can alter the coupling strengths between adjacent resonator parts.

A tuning physical adjustment (commonly abbreviated more simply as "adjustment") can then be defined as one or more manipulations of tuning structures and/or one or more operations causing one or more of the resonant frequencies or coupling strengths to be altered. For instance, such physical adjustment includes, but is not limited to, removal of material from a surface or face of a resonator component; drilling of holes in the resonator component; addition of material, such as silver, to a surface or face; addition of material, such as silver, to a hole or holes; adjustments of screws in the resonator component; and/or denting of material covering the resonator component.

What is needed to enable the part to be frequency tuned is an adjustment or adjustments which can alter the resonant frequency of the part by a sufficient amount to bring a typical manufactured part within specification.

What is needed to enable the coupling strength between adjacent pairs of parts to be tuned is an adjustment or a set of adjustments which can alter the coupling strength by a sufficient amount to bring the coupling strength between a typical adjacent pair of manufactured parts within specification.

SUMMARY

This section contains examples of possible implementations and is not meant to be limiting.

In an exemplary embodiment, a pair of joined dielectric resonator components of an RF filter includes a first dielectric resonator component and a second dielectric resonator component. The first dielectric resonator component includes a first block of dielectric material, which has a coating of a first conductive material and at least one planar face. The at least one planar face includes a first aperture formed by removing the coating of first conductive material from a portion of the planar face of the first block.

The second dielectric resonator component includes a second block of dielectric material, which has a coating of a second conductive material and at least one planar face. The at least one planar face includes a second aperture formed by removing the coating of second conductive material from a portion of the planar face of the second block.

The first and second dielectric resonator components are joined to one another with the coating of first conductive material on the planar face of the first block in contact with the coating of second conductive material on the planar face of the second block, and with the first aperture aligned with the second aperture. The second dielectric resonator component has a hole through the coating of second conductive material and into the second block of dielectric material. The hole is outside of the second aperture, and controls electric-field coupling between the first and second dielectric resonator components.

In another exemplary embodiment, a pair of joined dielectric resonator components of an RF filter also includes a first dielectric resonator component and a second dielectric resonator component. The first dielectric resonator component includes a first block of dielectric material, which has a coating of a first conductive material and at least one planar face. The at least one planar face includes a first aperture formed by removing the coating of first conductive material from a portion of the planar face of the first block.

The second dielectric resonator component includes a second block of dielectric material, which has a coating of a second conductive material and at least one planar face. The at least one planar face includes a second aperture formed by removing the coating of second conductive material from a portion of the planar face of the second block.

The first and second dielectric resonator components are joined to one another with the coating of first conductive material on the planar face of the first block in contact with the coating of second conductive material on the planar face of the second block, and with said first aperture aligned with said second aperture. The first aperture may have a first central island of first conductive material and the second aperture may have a second central island of second conductive material, the first central island being aligned with the second central island.

DETAILED DESCRIPTION OF THE DRAWINGS

Figure 1A:
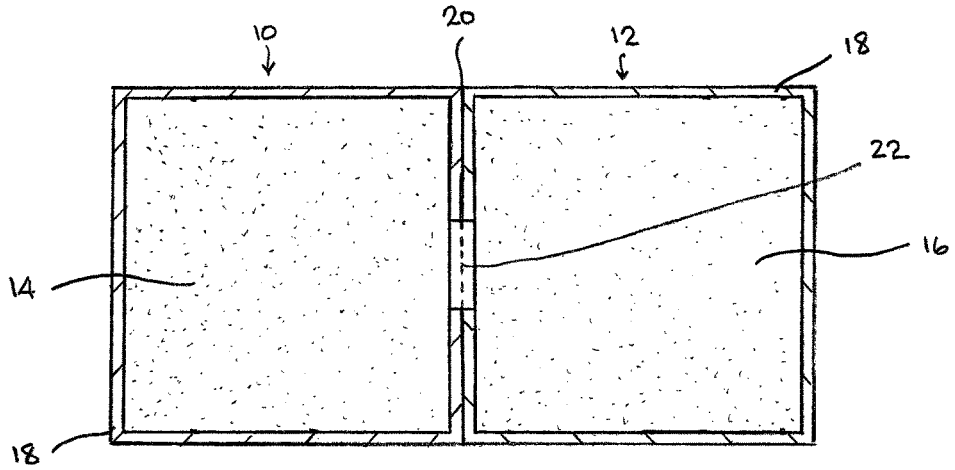
FIG. 1A is a cross-sectional view of a pair of joined dielectric resonator components having an open coupling aperture.

The word "exemplary" as used herein means "serving as an example, instance, or illustration." Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims.

As described above in part, what is needed to perform frequency tuning operations on individual separated resonant components of a filter is a frequency tuning structure on the part or a process by which the resonant frequencies of the part can be altered. What is needed to perform coupling strength tuning operations on adjacent pairs of parts is a tuning structure on the coupling structure of the pair of parts or a process by which the coupling strength between the parts may be altered.

The type of filter construction to which this invention applies is one composed of a number of metallized dielectric resonator components joined together. By "metallized" is meant that the dielectric resonator components have an exterior layer or coating of a conductive material, such as silver. In order to be able to form an intimate electrical contact between dielectric resonator components, the abutting regions of adjacent pairs of dielectric resonator components are planar. The planar contact regions themselves include one or more smaller regions from which the metallization, that is, the conductive coating, has been removed from both abutting regions, wherein the smaller regions are substantially identical in shape, size, and location, so that electromagnetic energy may be transferred from one dielectric resonator component to the next through the matching apertures formed by the selective removal of the metallization. The so-called coupling apertures may take many forms, including an open shape, such as a circle, square, oval, rectangle, or any other shape which the designer selects. An alternative type of coupling aperture has an outer boundary which may take any of the shapes described above for the open aperture, but having, in addition, a conductive region located inside the boundary. The conductive region may either be isolated from the boundary or be in electrical contact with the boundary, and may have any of the shapes described above. The exact shapes of the outer boundary and inner conductive region, and their relative locations are selected by the filter designer.

The coupling strength between the adjacent resonator components is determined in large part by the size and shape of the coupling apertures and by their location and orientation on the planar contact faces of the adjacent components. The aperture details and the resulting coupling strength is determined during the design process for the filter and forms part of the ideal filter design. The resonant frequencies of the adjacent resonator components form another part of the ideal filter design.

When a filter is being manufactured, it will usually be necessary to adjust the resonant frequencies of the adjacent components and will sometimes also be necessary to adjust the coupling strength between the two adjacent resonator components, both to compensate for manufacturing inaccuracies and to bring the filter incorporating these components within the required specification.

A filter of the sort described above can be temporarily assembled in part or in full so that the required changes to the resonant frequencies and coupling strength between the adjacent parts can be determined. An adjustment process for the frequencies and coupling strength can then be performed and the parts reassembled to determine whether the frequencies and coupling strength have been brought within specification.

While the filter components are disassembled, the planar contact faces are accessible, which allows modifications to be made to the planar contact faces, and to any structures, such as apertures, located on the planar contact faces. The coupling strength between the adjacent dielectric resonator components can be altered by forming a hole of selected diameter, depth and location in one of the planar contact surfaces. The hole may also penetrate the underlying dielectric material from which the resonator component is formed. The hole may be located either within the aperture or outside it, and the inner surface of the hole may be either metallized, that is, filled or lined with a conductive material, such as silver, or left unfilled as a raw dielectric surface. The hole alters the electric- and magnetic-field distributions inside the dielectric resonator component having the hole, and, to a lesser extent, in the adjacent dielectric resonator component. The amount by which the coupling strength between the parts is altered by the addition of this hole will depend upon the diameter, depth, and location of the hole, and whether it is subsequently metallized or silvered. One or more additional holes may be added, both to the dielectric resonator component having the first hole, and to the adjacent dielectric resonator component. Each additional hole will cause additional changes to the coupling strength. In addition to changing the coupling strength, the coupling adjustment holes will usually also alter the resonant frequencies of one or both of the adjacent dielectric resonator components.

As discussed above, the so-called tuning hole can be formed, and subsequently left raw and open, filled only with air, or it may be formed, and subsequently lined with a conductive material, or, equivalently, completely filled with a conductive material. A raw, air-filled hole will be referred to below as an unfilled hole, while a hole filled or lined with a conductive material will be referred to as a filled hole.

The presence of an unfilled hole in a dielectric resonator component causes an electric field therein to move away from the unfilled hole relative to where the electric field would be if the unfilled hole were absent. Conversely, the presence of a filled hole in a dielectric resonator component causes an electric field therein to move toward the filled hole relative to where the electric field would be if the unfilled hole were absent. The opposite behavior of the unfilled and filled holes in this regard causes opposite changes in the resonant frequency and coupling strength for a given hole location.

Figure 1B:
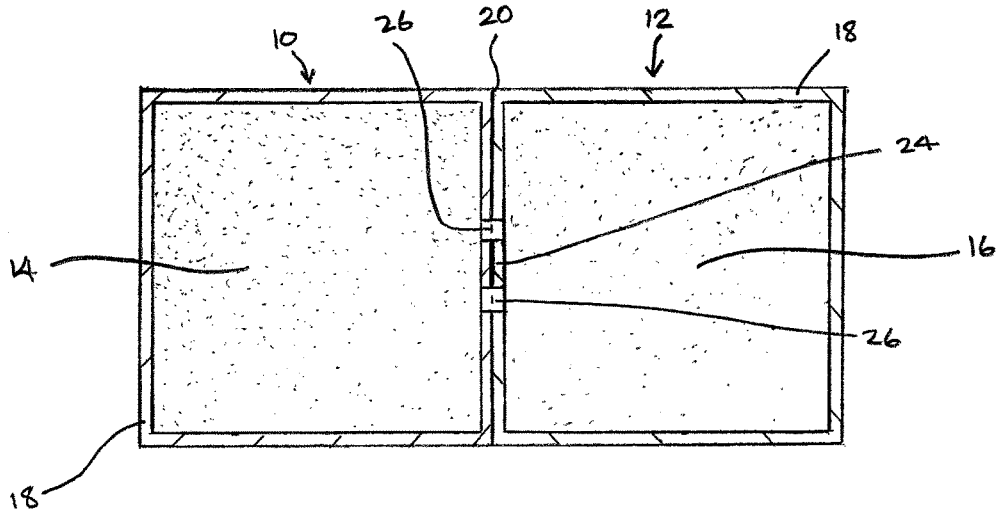
FIG. 1B is a cross-sectional view of a pair of joined dielectric resonator components having an annular coupling aperture.

Reference is now made to FIGS. 1A and 1B, which are cross-sectional views illustrating a pair of dielectric resonator components 10, 12 composed of dielectric blocks 14, 16, respectively, each having a conductive coating 18. The dielectric resonator components 10, 12 are joined together at a planar contact surface 20 and have a common coupling aperture 22 through which electromagnetic energy may be exchanged between the adjacent dielectric resonator components 10, 12. A coupling aperture 22 composed of a simple open region where the conductive coating is absent is shown in FIG. 1A, and will be referred to as an open aperture. Coupling aperture 22 may be circular in shape when viewed perpendicularly to the planar contact surface 20. An alternative coupling aperture 26 is shown in FIG. 1B. The alternative coupling aperture 26 has an internal conductive region 24 surrounded by a region where the conductive coating has been removed. This region, which forms the alternative coupling aperture 26, isolates the internal conductive region 24 from the surrounding conductive coating 18. Alternative coupling aperture 26 may be annular in shape surrounding an island, the internal conductive region 24, when viewed perpendicularly to the planar contact surface 20. This coupling aperture will be referred to as an annular aperture.

The typical resonant modes in dielectric resonator components 10, 12, such as those shown in FIGS. 1A and 1B, have an electric field passing from one side of the dielectric resonator component 10, 12 to the opposite side, the electric field being strongest in the center of the dielectric resonator component 10, 12. When the electric-field directions in the two dielectric resonator components 10, 12 are substantially parallel to one another and substantially perpendicular to the planar contact surface 20, the apertures 22, 26 predominantly couple via the electric field. The strength of electric-field coupling is determined by the amount of the electric field passing between the two dielectric resonator components 10, 12 through the aperture 22, 26.

Figure 2A:
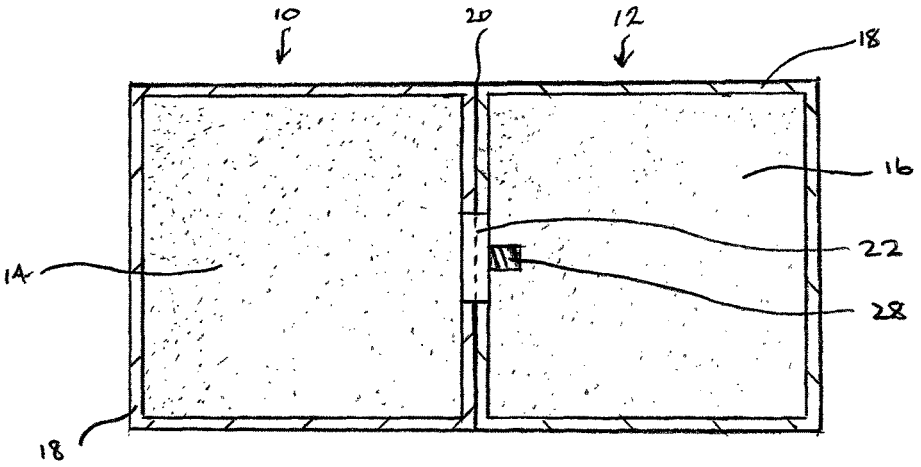
FIG. 2A is a cross-sectional view of a pair of dielectric resonator components having an open aperture and a conductive-material filled hole inside the open aperture.

FIG. 2A, which is another cross-sectional view illustrating a pair of dielectric resonator components 10, 12 composed of dielectric blocks 14, 16, respectively, each having a conductive coating 18, illustrates a filled hole 28 inside an open aperture 22. As discussed above, the filled hole 28 attracts the electric field. As the filled hole 28 is inside the open aperture 22, it draws the electric field toward the open aperture 22 leading to an increase in the electric-field coupling strength between the two dielectric resonator components 10, 12. The presence of the filled hole will also cause the resonant frequency of dielectric resonator component 12 to decrease. This can be understood as arising from an increase in the capacitance from one face of dielectric resonator component 12 to the other and an increase in the inductance seen by the circulating currents inside dielectric resonator component 12. Both of these effects will decrease the resonant frequency.

Figure 2B:
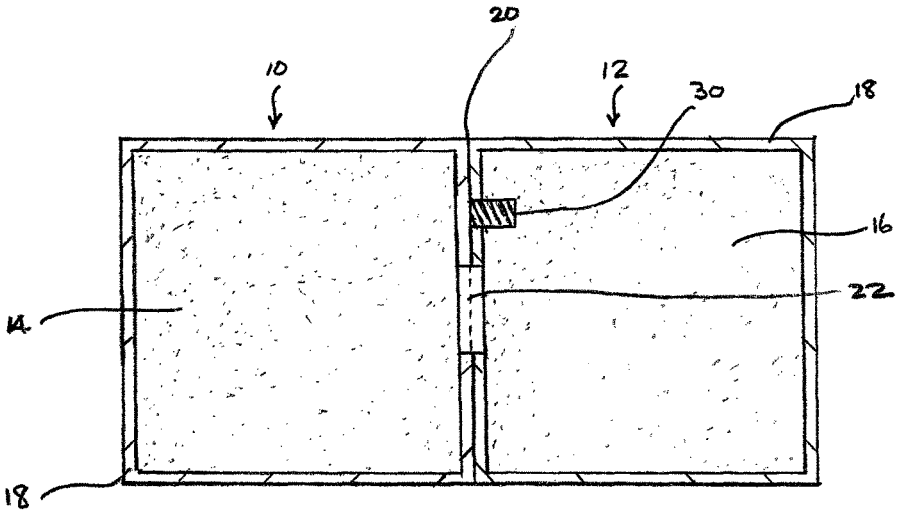
FIG. 2B is a cross-sectional view of a pair of dielectric resonator components having an open aperture and a conductive-material filled hole outside the open aperture.

FIG. 2B, which is a similar cross-sectional view, illustrates a filled hole 30 outside the open aperture 22. As depicted in FIG. 2B, filled hole 30 was produced by drilling, or otherwise forming, a hole through conductive coating 18 and into dielectric block 16, and subsequently filling or lining the hole with a conductive material, such as silver, so that the conductive material inside the hole makes electrical contact with conductive coating 18. As described in the preceding paragraph, the filled hole 30 draws the electric field towards itself and away from open aperture 22, and therefore decreases the electric-field coupling strength. Filled hole 30 also decreases the resonant frequency for the same reason as given in the preceding paragraph in connection with FIG. 2A.

Figure 3A:
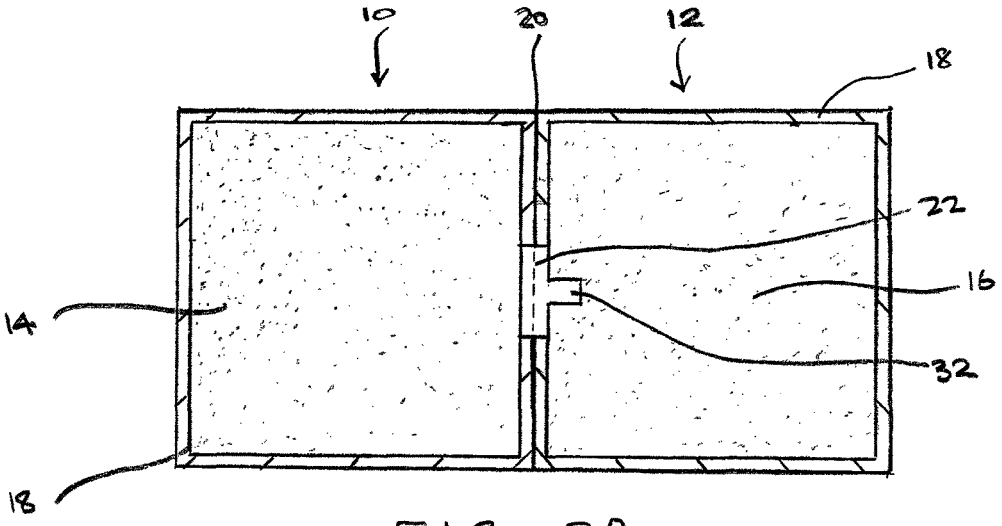
FIG. 3A is a cross-sectional view of a pair of dielectric resonator components having an open aperture and an unfilled hole inside the open aperture.

FIG. 3A, which is another cross-sectional view similar to those described thus far, illustrates an unfilled hole 32 inside an open aperture 22. As discussed above, unfilled hole 32 causes the electric field to move away from its location. As a consequence, the electric field is deflected away from open aperture 22, thereby decreasing the electric-field coupling strength. The presence of the unfilled hole 32 decreases the capacitance from one face of the dielectric resonator component 12 to the other, thereby increasing the resonant frequency.

Figure 3B:
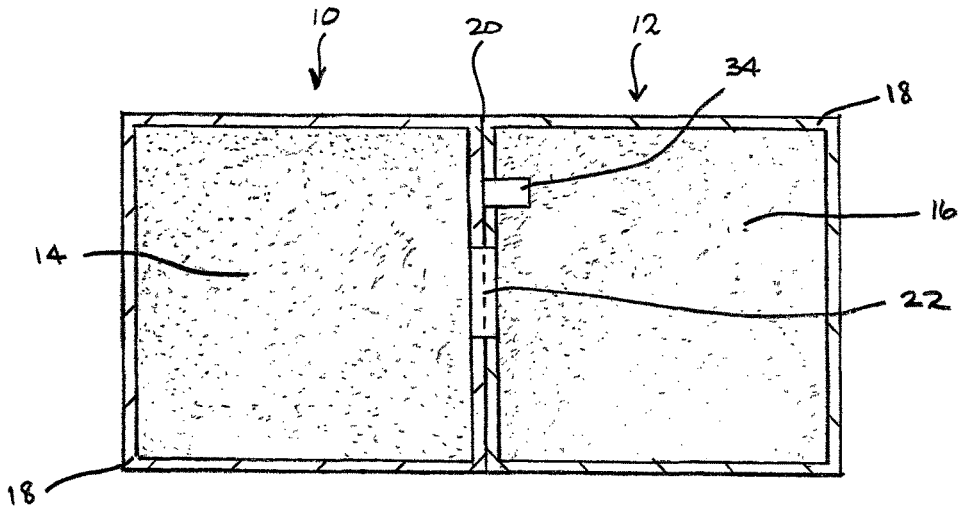
FIG. 3B is a cross-sectional view of a pair of dielectric resonator components having an open aperture and an unfilled hole outside the open aperture.

FIG. 3B, a cross-sectional view like that of FIG. 3A, illustrates an unfilled hole 34 outside open aperture 22. Unfilled hole 34 was produced by drilling, or otherwise forming, a hole through conductive coating 18 and into dielectric block 16, and is capped, or closed off, by conductive coating 18 of dielectric resonator component 10. Unfilled hole 34 causes the electric field to move away from its location and toward open aperture 22, thereby increasing the electric-field coupling strength. Unfilled hole 34 also increases the resonant frequency for the same reason as given in the preceding paragraph in connection with FIG. 3A.

Figure 4A:
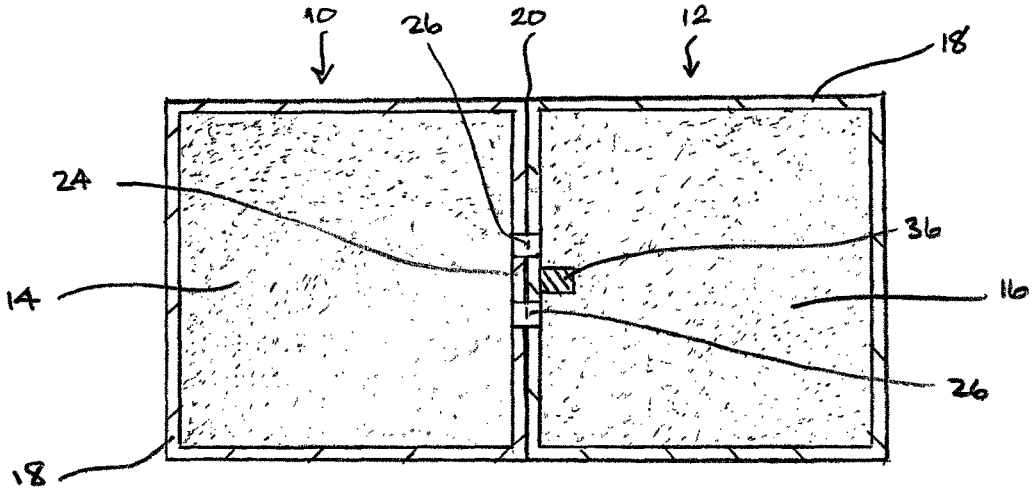
FIG. 4A is a cross-sectional view of a pair of dielectric resonator components having an annular aperture and a conductive-material filled hole in the internal conductive region of the annular aperture.
Figure 4B:
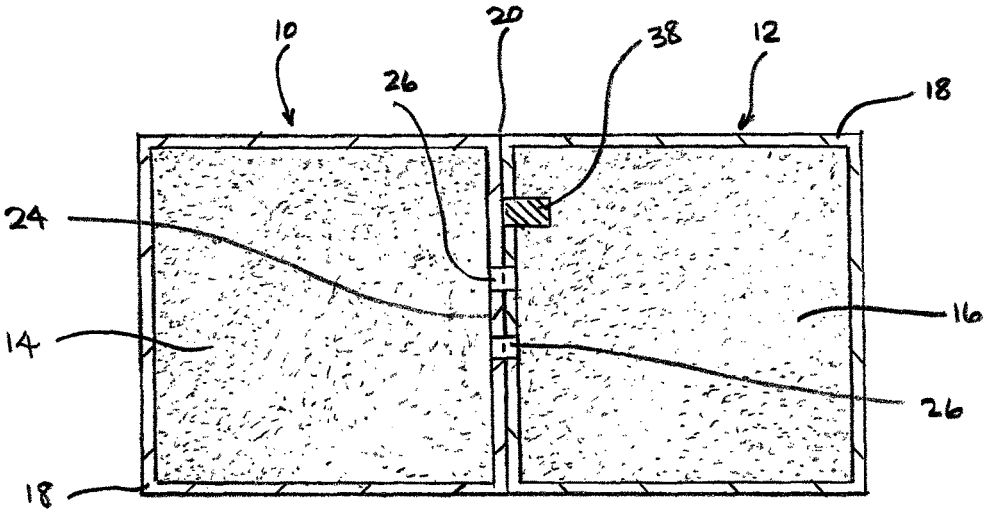
FIG. 4B is a cross-sectional view of a pair of dielectric resonator components having an annular aperture and a conductive-material filled hole outside the annular aperture.

FIGS. 4A and 4B are cross-sectional views analogous to those of FIGS. 2A and 2B for cases where an annular aperture 26 is provided instead of an open aperture 22. Referring first to FIG. 4A, a filled hole 36 is provided in internal conductive region 24 of dielectric resonator component 12. As depicted in FIG. 4A, filled hole 36 was produced by drilling, or otherwise forming, a hole in dielectric block 16 after dielectric block 16 was covered with conductive coating 18, and annular aperture 26 was formed around internal conductive region 24 by removing some of the conductive coating 18, and a hole was formed through internal conductive region 24 and into dielectric block 16, and subsequently filled or lined with a conductive material, such as silver, so that the conductive material inside the hole makes electrical contact with conductive coating 18. As discussed above in connection with FIG. 2A, the filled hole 36 attracts the electric field. As the filled hole 36 is within the annular aperture 26, it draws the electric field toward the annular aperture 26 leading to an increase in the electric-field coupling strength between the two dielectric resonator components 10, 12. The presence of the filled hole will also cause the resonant frequency of dielectric resonator component 12 to decrease. This can be understood as arising from an increase in the capacitance from one face of dielectric resonator component 12 to the other and an increase in the inductance seen by the circulating currents inside dielectric resonator component 12. Both of these effects will decrease the resonant frequency.

Turning to FIG. 4B, a filled hole 38 is provided outside the annular aperture 26. As depicted in FIG. 4B, filled hole 38 was produced by drilling, or otherwise forming, a hole through conductive coating 18 and into dielectric block 16, and subsequently filling or lining the hole with a conductive material, such as silver, so that the conductive material inside the hole makes electrical contact with conductive coating 18. As described previously, filled hole 38 draws the electric field towards itself and away from annular aperture 26, and therefore decreases the electric-field coupling strength. Filled hole 38 also decreases the resonant frequency as was the case in connection with FIG. 4A.

Figure 5A:
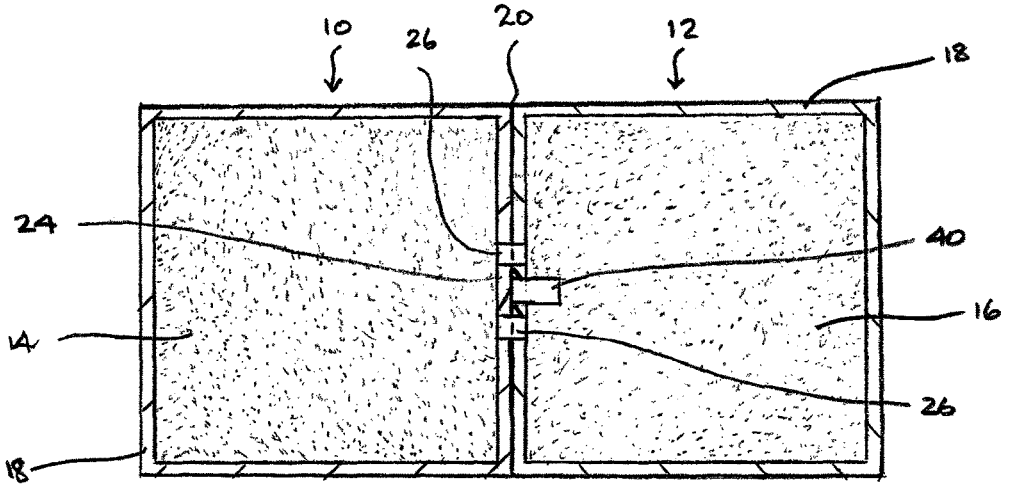
FIG. 5A is a cross-sectional view of a pair of dielectric resonator components having an annular aperture and an unfilled hole in the internal conductive region of the annular aperture.
Figure 5B:
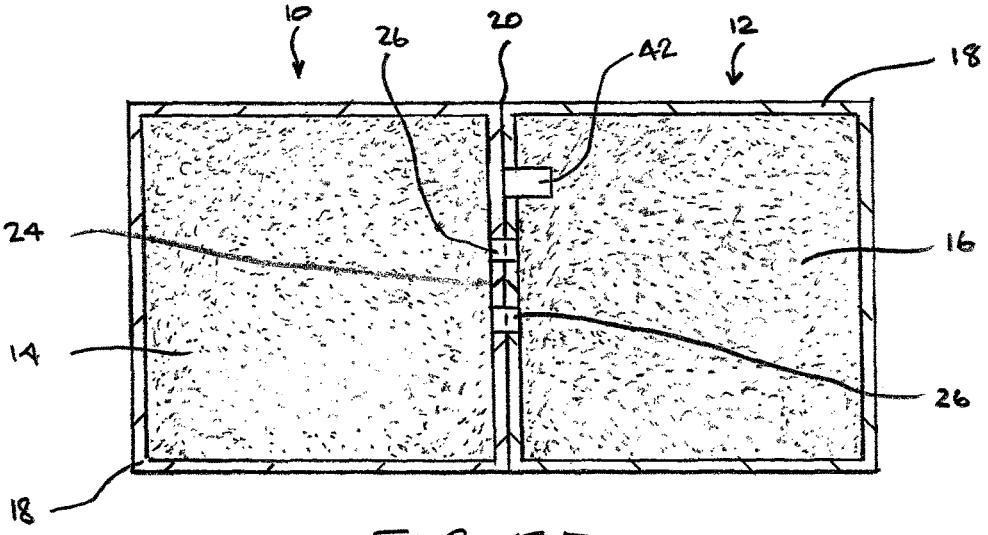
FIG. 5B is a cross-sectional view of a pair of dielectric resonator components having an annular aperture and an unfilled hole outside the annular aperture.

FIGS. 5A and 5B are cross-sectional views analogous to those of FIGS. 3A and 3B for cases where an annular aperture 26 is provided instead of an open aperture 22. Referring first to FIG. 5A, an unfilled hole 40 is provided in internal conductive region 24 of dielectric resonator component 12, and is capped, or closed off, by internal conductive region 24 of dielectric resonator component 10. As previously discussed, unfilled hole 40 causes the electric field to move away from its location. As a consequence, the electric field is deflected away from annular aperture 26, thereby decreasing the electric-field coupling strength. The presence of the unfilled hole 40 decreases the capacitance from one face of the dielectric resonator component 12 to the other, thereby increasing the resonant frequency.

FIG. 5B, a cross-sectional view like that of FIG. 5A, illustrates an unfilled hole 42 outside annular aperture 26. Unfilled hole 42 was produced by drilling, or otherwise forming, a hole through conductive coating 18 and into dielectric block 16, and is capped, or closed off, by conductive coating 18 of dielectric resonator component 10. Unfilled hole 42 causes the electric field to move away from its location and toward annular aperture 26, thereby increasing the electric-field coupling strength. Unfilled hole 42 also increases the resonant frequency for the same reason as given in the preceding paragraph in connection with FIG. 5A.

When a filled hole 30, 36, 38 is formed in the planar contact surface 20 of a dielectric resonator component 10, 12, the conductive material filling or lining the hole allows the outer surface of the hole to act as a continuation of the conductive coating 18 of the dielectric resonator component 10, 12. As a consequence, the presence of a filled hole in one dielectric resonator component 12 does not interfere with the adjacent dielectric resonator component 10.

However, this is not the case with unfilled holes. When an unfilled hole is formed at a location where it would normally be covered, or capped, with conductive coating 18 of an adjacent dielectric resonator component 10, 12, such as unfilled holes 34, 40, 42 shown in FIGS. 3B, 5A, and 5B, respectively, the top of the hole remains open, electrically speaking, and can therefore be considered to be a small aperture. When an adjacent dielectric resonator component 10, 12 also has an unfilled hole at the same location, additional electric-field coupling can occur through the aligned unfilled holes, each of which would essentially be uncapped.

Figure 6A:
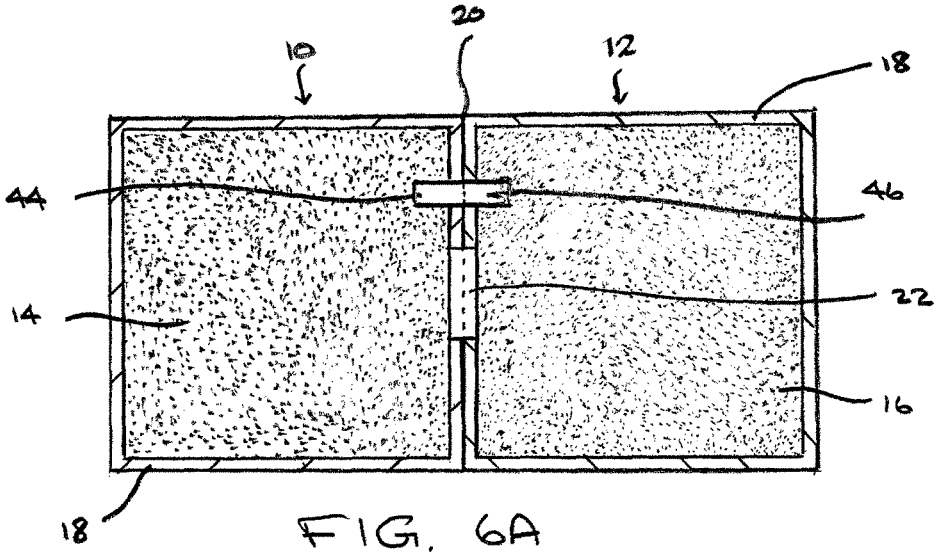
FIG. 6A is a cross-sectional view of a pair of dielectric resonator components having an open aperture and aligned unfilled holes outside the open aperture.
Figure 6B:
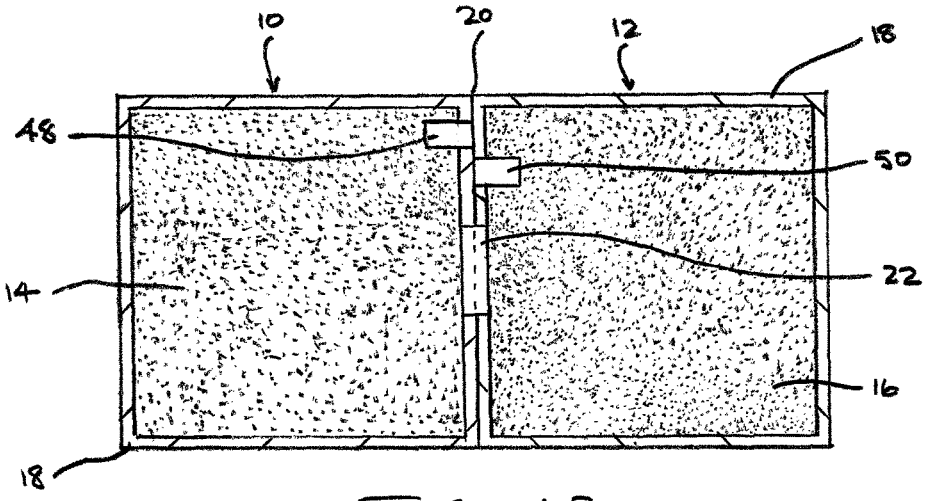
FIG. 6B is a cross-sectional view of a pair of dielectric resonator components having an open aperture and unaligned unfilled holes outside the open aperture.

Such a situation is shown in FIG. 6A, where unfilled holes 44, 46 are aligned with one another. To avoid potentially unwanted additional electric-field coupling, unfilled holes should not be formed in locations aligned with one another. Instead, unfilled holes in adjacent dielectric resonator components 10, 12 should be offset relative to one another, as are unfilled holes 48, 50 in FIG. 6B, where unfilled hole 48 in dielectric resonator component 10 is capped by conductive coating 18 on dielectric resonator component 12, and unfilled hole 50 in dielectric resonator component 12 is capped by conductive coating 18 on dielectric resonator component 10.

In order to illustrate the variations in resonant frequency and electric-field coupling frequency which typically occur when either an unfilled or a filled hole is formed in the planar contact surface of a pair of adjacent dielectric resonator components, a completely symmetrical pair of dielectric resonator components was modelled. Identical holes, filled or unfilled, were placed in the same location on both dielectric resonator components; in other words, they were aligned with one another. To prevent unwanted electric-field coupling through the aligned unfilled holes, as discussed above in connection with FIG. 6A, the modelled holes did not penetrate the conductive coating 18, but only penetrated dielectric blocks 14, 16. As a result, the conductive coating 18 remained intact over the unfilled holes and thereby capped them, preventing unwanted additional electric-field coupling. The electric-field coupling strength was then taken to be one half of the difference between the odd and even eigenmode frequencies of the symmetrical pair. The frequency was taken to be the average of the odd and even eigenmode frequencies. This symmetrical model greatly simplifies the calculation, but still gives results which are representative of the manner in which the resonant frequency and electric-field coupling strength change in a more realistic situation. The changes occurring when a single tuning hole in one of the pair of dielectric resonator components is used are of a similar form, but are reduced somewhat in magnitude relative to the results to be described below.

The dielectric resonator components modelled in the calculations were cuboids of size 4×18×18 mm and composed of a material with a dielectric constant of 45. The thickness of the conductive coating was taken to be 20 μm. Two different types of coupling aperture were used. One type was a circular open aperture of diameter 4 mm and located in the center of the square coupling face (planar contact surface) of both dielectric resonator components. The second type was an annular aperture in the same location and having a 4 mm outer diameter and an annular gap width of 0.4 mm.

Figure 7A:
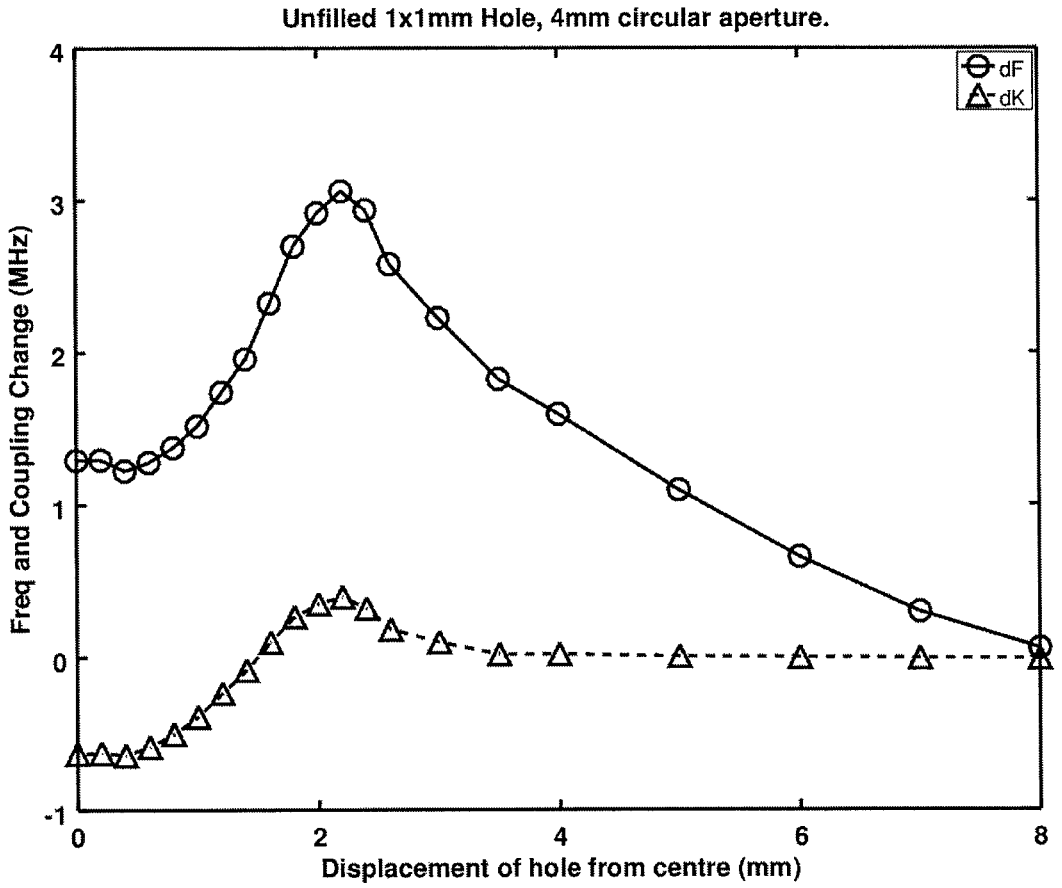
FIG. 7A presents plots of the changes in resonant frequency and electric-field coupling against the position of an unfilled hole relative to the center of an open aperture.

FIG. 7A shows the changes in the resonant frequency and electric-field coupling which occur in a pair of dielectric resonator components coupled by the above-mentioned 4-mm-diameter open aperture when an unfilled hole of 1 mm diameter and 1 mm depth is formed in a range of locations starting from the center of the open aperture and moving out toward the edge of the planar contact surfaces of the dielectric resonator components. The solid curve with circular markers shows the resonant frequency changes while the dashed curve with triangular markers shows the electric-field coupling changes. When the two aligned holes are close to the center, the electric-field coupling is decreased by about 700 kHz and the resonant frequency is increased by about 1.2 MHz. As the aligned holes move outward, the change in the electric-field coupling diminishes, until it reaches zero when the hole is about 1.5 mm away from the center. This corresponds to a point where the edge of the holes starts to cross the boundary of the open aperture. The change in the electric-field coupling then becomes positive, and remains so as the holes move farther outward. The greatest positive change in the electric-field coupling occurs when the center of the holes is over the aperture boundary. The resonant frequency is increased for all hole positions, but reaches a maximum magnitude when the holes are located slightly outside the location giving maximum coupling change. For hole locations greater than about 4 mm from the center, the change in the electric-field coupling is negligible, while the change in the resonant frequency remains significant, but gradually decreases toward zero.

Figure 7B:
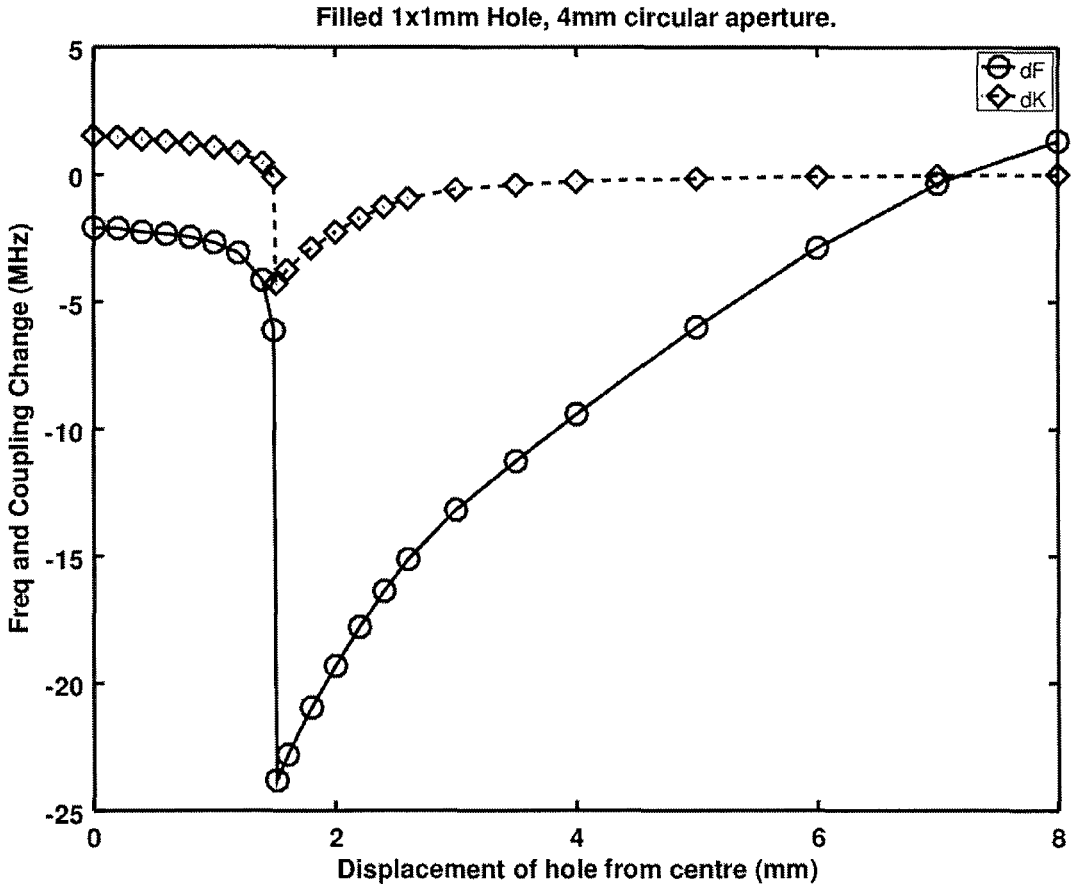
FIG. 7B presents plots of the changes in resonant frequency and electric-field coupling against the position of a conductive-material filled hole relative to the center of an open aperture.

FIG. 7B shows the changes in resonant frequency and electric-field coupling which occur when the above unfilled holes are replaced by filled holes of the same diameter, depth, and location. The solid curve with circular markers shows the changes in the resonant frequency, while the dashed curve with diamond-shaped markers shows the changes in the electric-field coupling. When the holes are close to the center of the open apertures, the electric-field coupling increases by about 1.5 MHz, while the resonant frequency decreases by about 2 MHz. As the holes move outward, the change in the electric-field coupling diminishes, but then undergoes an abrupt change to a negative value as the filled holes contact the boundary of the open aperture, which causes a sudden decrease in the effective area of the open aperture because the filled holes electrically become part of the boundary. As the holes move farther out, the overlap between the filled holes and the open aperture decreases, and the effective area of the open aperture gradually increases. As a result, the magnitudes of the changes in the resonant frequency and the electric-field coupling gradually diminish as the holes move outward. The change in the resonant frequency remains significant for almost all hole locations, whereas the change in the electric-field coupling becomes negligible for hole locations greater than about 3 mm from the center of the open aperture.

Figure 7C:
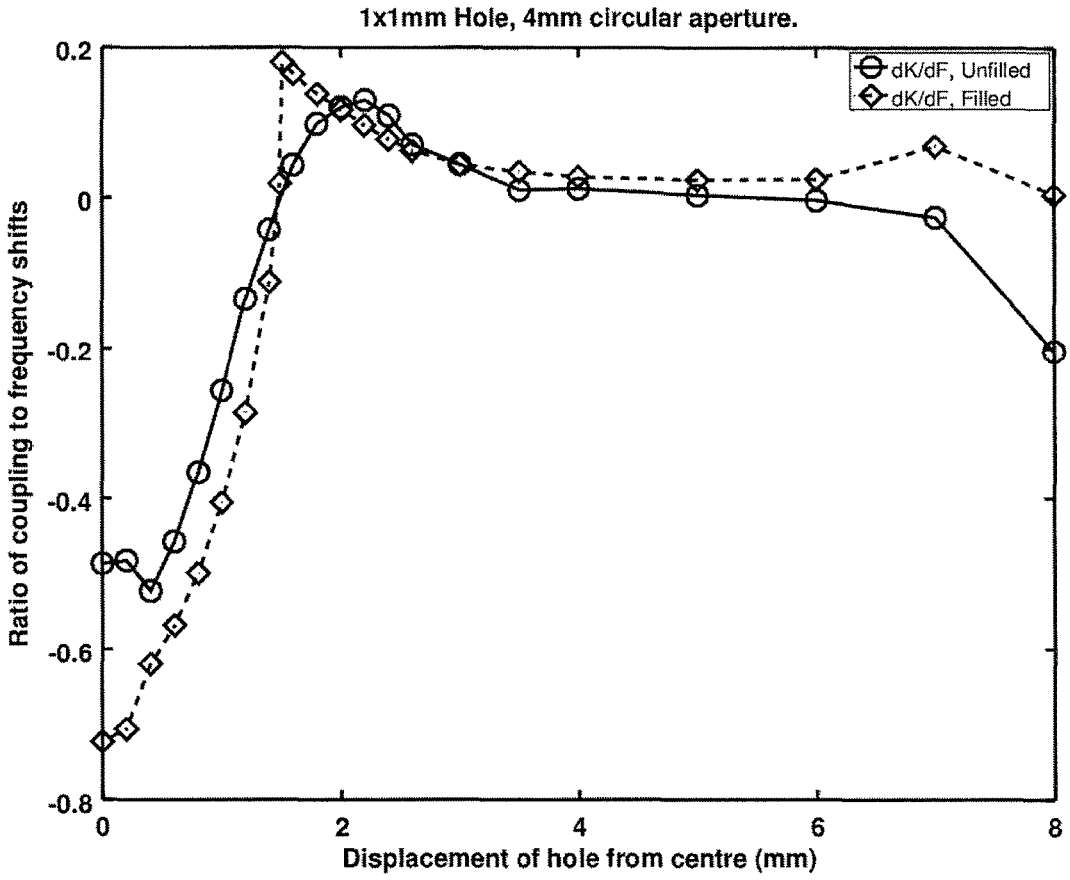
FIG. 7C presents plots of the ratios of the change in electric-field coupling to the change in resonant frequency against the position of conductive-material filled and unfilled holes relative to the center of an open aperture.

In a realistic tuning situation, the changes in both resonant frequency and electric-field coupling will be important, and both will need to be controlled. It is thus important to consider relative changes in resonant frequency and electric-field coupling. FIG. 7C shows the ratio of the change in the electric-field coupling to the change in the resonant frequency as a function of the location of both unfilled and filled holes for the dielectric resonator components with a circular open aperture. The solid curve with circular markers shows the ratio for unfilled holes, while the dashed line with diamond-shaped markers shows the ratio for filled holes. When the unfilled holes are close to the center the ratio is close to −0.5 which means that a 1 MHz coupling shift will be accompanied by a 2 MHz frequency shift of opposite sign. Thus, if it is desired to minimize unwanted frequency shifts, the holes should be placed in the center, but even here the unwanted frequency shift is quite large. When the hole is between about 3 mm and 6 mm from the center, the ratio drops towards zero, which means that almost all of the change will be to the frequency with negligible change to the electric-field coupling. Thus, when it is desired to change the frequency but not the electric-field coupling, the holes should be placed about midway between the edge of the aperture and the edge of the slab. In summary, in both cases, holes in the open apertures give the largest change in electric-field coupling relative to the change in resonant frequency, while the smallest occurs when the holes are located between about 3 mm and 6 mm from the center of the open aperture.

Figure 8A:
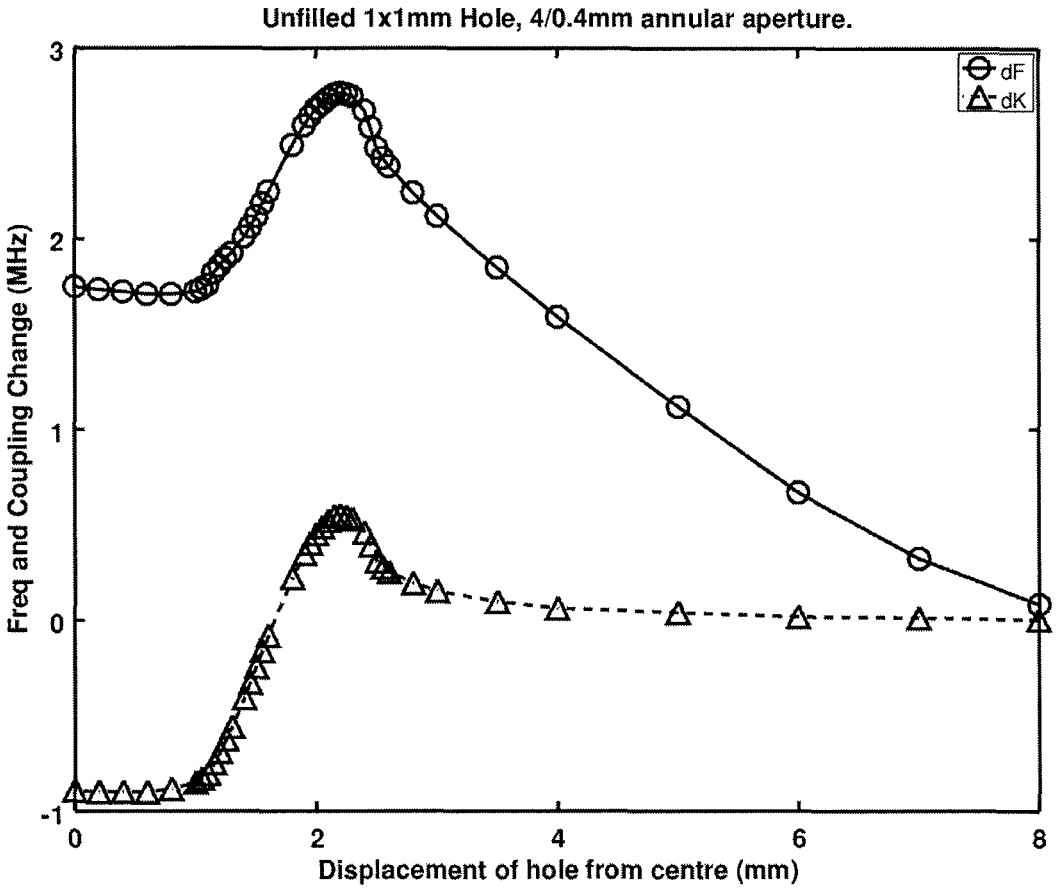
FIG. 8A presents plots of the changes in resonant frequency and electric-field coupling against the position of an unfilled hole relative to the center of an annular aperture.

FIG. 8A shows the changes in the resonant frequency and the electric-field coupling which occur in a pair of dielectric resonator components coupled by the above mentioned 4-mm-diameter annular aperture when an unfilled hole of 1 mm diameter and 1 mm depth is formed in a range of locations starting from the center of the annular aperture and is moved out toward the edge of the planar contact surfaces of the dielectric resonator structures. The solid curve with circular markers shows the changes in the resonant frequency, while the dashed curve with triangular markers shows the changes in the electric-field coupling. When the holes are close to the center, the electric-field coupling is decreased by about 900 kHz and the resonant frequency is increased by about 1.8 MHz. As the holes move outward, the change in the electric-field coupling remains approximately constant until the hole reaches about 1.6 mm from the center, which corresponds to the location where the edge of the holes meets the inner edge of the annular aperture. At this point, the change in the electric-field coupling starts to diminish until it reaches zero when the hole is about 1.8 mm away from the center. This corresponds to the point where the edge of the hole starts to cross the outer edge of the annular aperture. The change in the electric-field coupling then becomes positive and remains so as the holes move further outward. The greatest positive change in the electric-field coupling occurs when the inner edge of the holes are approximately lined up with the outer edge of the annular aperture. At this position, the unfilled holes deflect a maximum amount of electric field into the annular aperture. The resonant frequency is increased for all hole positions, but reaches a maximum magnitude when the holes are located in the location giving maximum change in the electric-field coupling. For hole locations greater than about 4 mm from the center, the coupling change in the electric-field coupling is negligible, while the change in the resonant frequency remains significant, but gradually decreases.

Figure 8B:
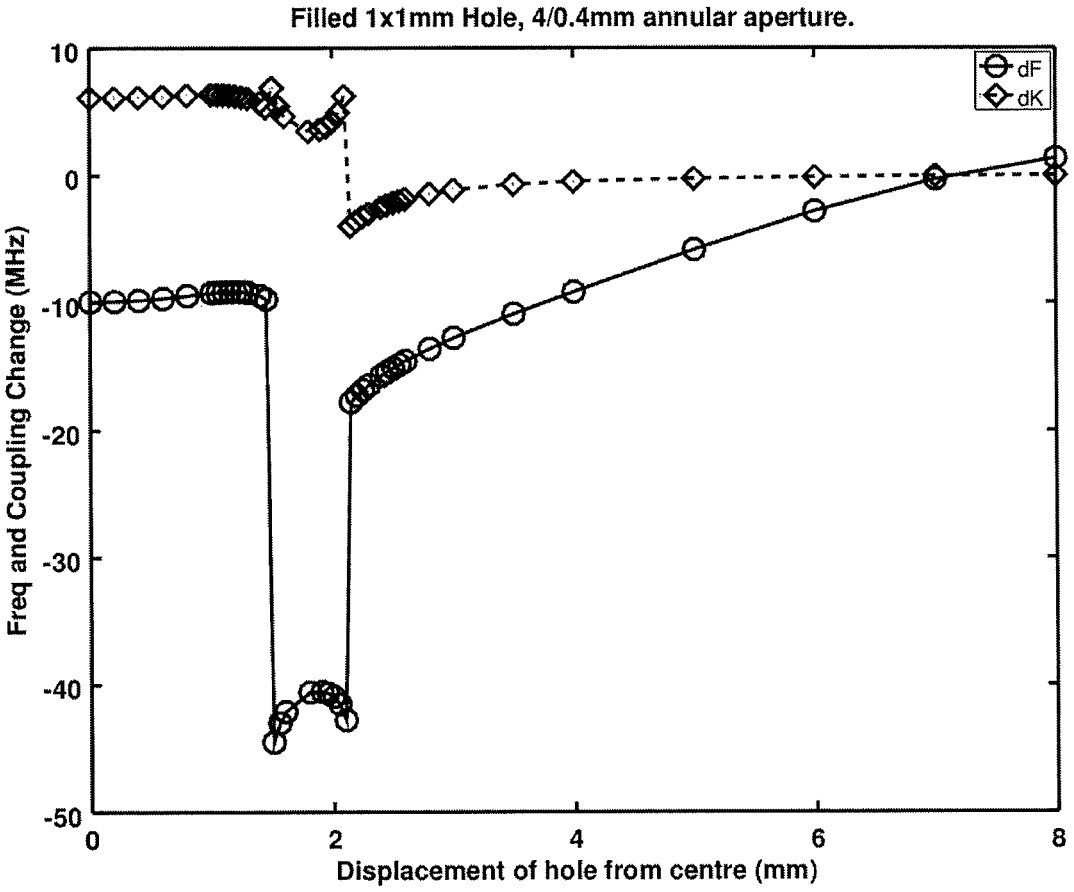
FIG. 8B presents plots of the changes in resonant frequency and electric-field coupling against the position of a conductive-material filled hole relative to the center of an annular aperture.

FIG. 8B shows the changes to the resonant frequency and electric-field coupling which occur when the unfilled holes are replaced by filled holes of the same diameter, depth, and location. The solid curve with circular markers shows the changes in the resonant frequency, while the dashed curve with diamond-shaped markers shows the changes in the electric-field coupling. When the filled holes are close to the center, the electric-field coupling increases by about 7 MHz, while the resonant frequency decreases by about 10 MHz. As the holes move outward, the change in the electric-field coupling remains approximately constant until the filled holes are about 1 mm from the center, after which the change in the electric-field coupling starts to diminish. This corresponds to where the outer edge of the filled hole starts to pass into the annular aperture. The filled holes then become part of the inner boundary of the annular aperture, thereby decreasing the effective area of the annular aperture and so decreasing the electric-field coupling. This trend continues until the filled holes reach about 1.6 mm from the center, at which point the outer edge of the filled holes contact the outer boundary of the annular aperture. This contact short-circuits the internal conductive region of the annular aperture to the outer boundary causing an abrupt decrease in the resonant frequency. This is caused by the current flowing inside the dielectric resonator component suddenly gaining access to the internal conductive region of the annular aperture. The electric-field coupling does not change very much at this point, and remains fairly constant until the hole location reaches about 2.1 mm, which corresponds to the point where the inner edge of the filled holes break contact with the inner edge of the internal conductive region of the aperture. At this point, the resonant frequency makes another abrupt change and the change in electric-field coupling makes an abrupt drop from positive to negative. The magnitude of the change in the electric-field coupling diminishes as the hole continues to move outward, dropping to negligible values for locations greater than about 3 mm or 4 mm from the center. The change in the resonant frequency remains significant for almost all hole locations.

Figure 8C:
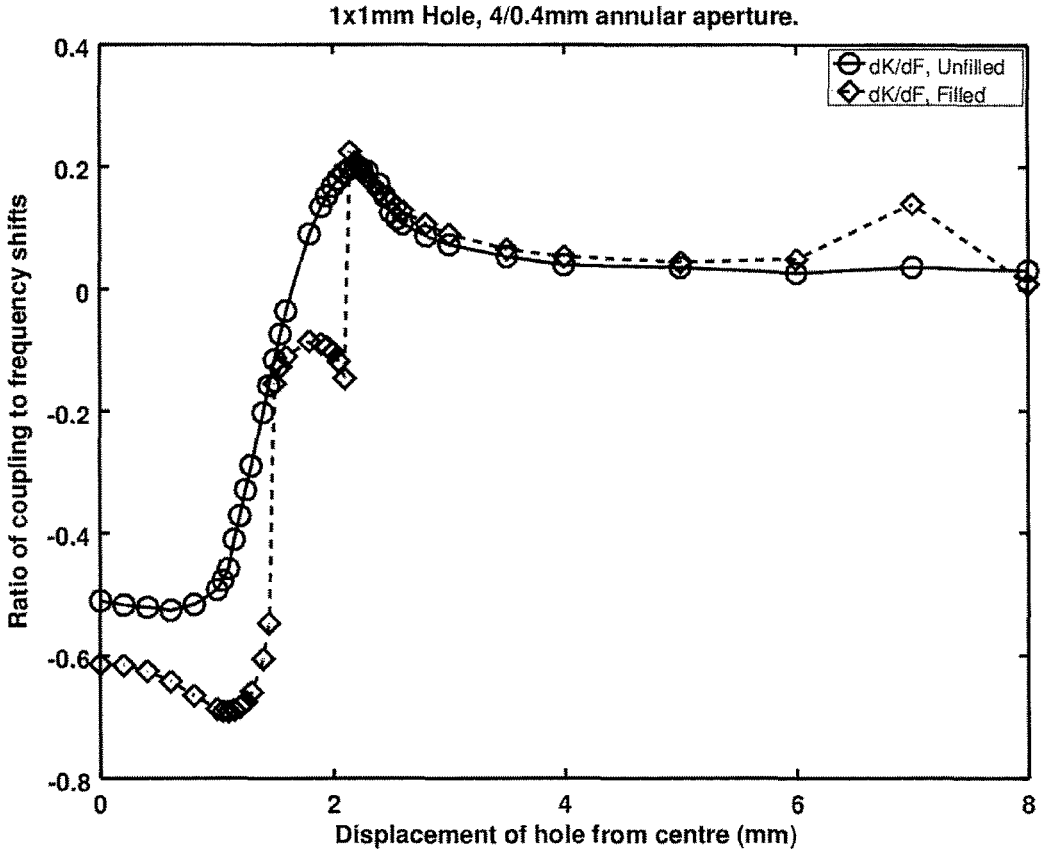
FIG. 8C presents of the ratios of the change in electric-field coupling to the change in resonant frequency against the position of conductive-material filled and unfilled holes relative to the center of an annular aperture.

FIG. 8C shows the ratio of the change in electric-field coupling to the change in resonant frequency as a function of the location of both unfilled and filled holes for the above dielectric resonator components with an annular aperture. The solid curve with circular markers shows the ratio for unfilled holes, while the dashed line with diamond-shaped markers shows the ratio for a filled hole. The curve shapes here are broadly similar to that in FIG. 7C for the circular open aperture. In both FIGS. 7C and 8C, a centrally located hole, filled or unfilled, gives the largest change in electric-filed coupling relative to the change in resonant frequency, while the smallest occurs when the hole is located between about 4 mm and 6 mm from the center.

As discussed above, in a realistic tuning situation the changes in both resonant frequency and electric-field coupling will be important, and both will need to be controlled. Fortunately, more than one hole may be formed in the planar contact surfaces of the adjacent dielectric resonator components. By forming extra holes, extra degrees of freedom to allow both the resonant frequency and electric-field coupling to be controlled are gained. In a general situation, two adjacent dielectric resonator components will have three parameters needing to be controlled: the two resonant frequencies of the dielectric resonator components and the electric-field coupling between them. At a minimum, this will require three holes to control. For example, a first hole could be formed outside the aperture of the first dielectric resonator component, where the first hole can mainly control the resonant frequency of the first component. A second hole could then be faulted outside the aperture of the second dielectric resonator component, where the second hole can mainly control the resonant frequency of the second dielectric resonator component. Finally, a third hole could be formed in the center of the aperture, where it will control both the electric-field coupling and the two resonant frequencies. This will supply the required three degrees of freedom.

Figure 9A:
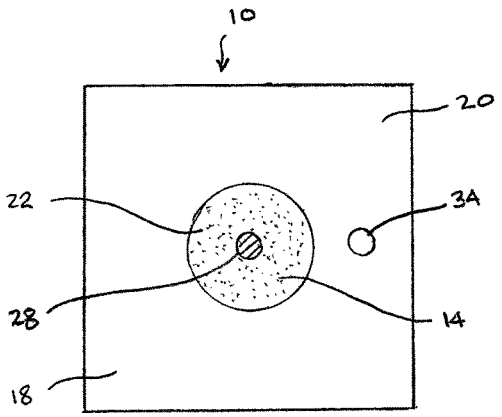
FIG. 9A is a plan view of the planar contact surface of a dielectric resonator component having an open aperture with a conductive-material filled hole and an unfilled hole outside of the open aperture.
Figure 9B:
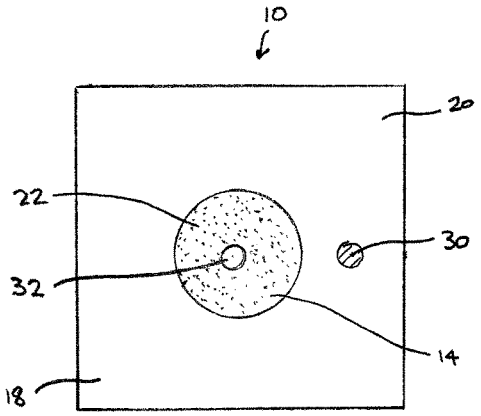
FIG. 9B is a plan view of the planar contact surface of a dielectric resonator component having an open aperture with an unfilled hole and a conductive-material filled hole outside of the open aperture.

An example of the use of multiple holes is illustrated in FIGS. 9A and 9B. These show a plan view of the planar contact surface 20 of dielectric resonator component 10 with an open aperture 22. In the center of the open aperture 22 is a filled hole 28, as shown in FIG. 2A. Outside the open aperture 22 is an unfilled hole 34, as shown in FIG. 3B. The filled hole 28 and the unfilled hole 34 are provided to control both the resonant frequency and the electric-field coupling. Filled hole 28 increases the electric-field coupling and decreases the resonant frequency, while unfilled hole 34 mainly increases the resonant frequency.

The opposite arrangement is shown in FIG. 9B. In the center of the open aperture 22 is an unfilled hole 32, as shown in FIG. 3A. Outside the open aperture 22 is a filled hole 30, as shown in FIG. 2B. Unfilled hole 32 decreases the electric-field coupling and increases the resonant frequency, and filled hole 30 mainly decreases the resonant frequency.

As an example to illustrate the use of a combination of holes, we consider the symmetrical model discussed above in the discussion of FIGS. 7A to 7C, and 8A to 8C. In this model there is only one frequency to alter, and because the symmetry of the model requires identical holes on both sides of the planar contact surface 20, it is not possible to alter more than one frequency. Fortunately, the essential behavior of the combination of holes can still be illustrated using this simplified model.

The same dielectric resonator components as introduced above are used, including the 4-mm-diameter circular open aperture. Let us suppose that we need to increase the electric-field coupling strength by about 2 MHz, again without significantly changing the resonant frequency. The desired change in electric-field coupling can be achieved by providing a filled hole with a diameter of 1 mm and a depth of 0.82 mm in the center of the open aperture. This will cause the electric-field coupling to increase by 1.98 MHz and the resonant frequency to decrease by 1.5 MHz. If a second unfilled hole with a diameter of 1.2 mm and a depth of 1 mm located 5 mm away from the center of the open aperture is provided, then the electric-field coupling increases by 2.1 MHz and the resonant frequency increases by 0.2 MHz.

Now let us suppose that we need to decrease the electric-field coupling by about 2 MHz without significantly changing the resonant frequency. The desired change in the electric-field coupling can be achieved by forming an unfilled hole with a diameter of 1.2 mm and a depth of 1 mm in the center of the open aperture. This will cause the electric-field coupling to decrease by 1.94 MHz and the resonant frequency to increase by 1.85 MHz. If we then provide second filled hole with a diameter of 1 mm and a depth of 0.6 mm located 5 mm away from the center of the open aperture, then the electric-field coupling decreases by 2.1 MHz and the resonant frequency decreases by 0.2 MHz.

These examples demonstrate two possible ways in which multiple holes may be used to control both resonant frequency and electric-field coupling. Many different hole combinations are possible, but all rely on the fact that the ratio of the change in electric-field coupling to the change in resonant frequency varies considerably as the location of the hole, filled or unfilled, is changed, as illustrated in FIGS. 7C and 8C. In particular, a hole in the center of the aperture causes a large coupling change, while a hole about halfway between the edge of the aperture and the outer edge of the dielectric resonator component causes a significant resonant frequency change with only a very small change in electric-field coupling. Further, the change in resonant frequency resulting from the central hole can be compensated by a hole of the opposite type located outside the aperture.

Figure 10A:
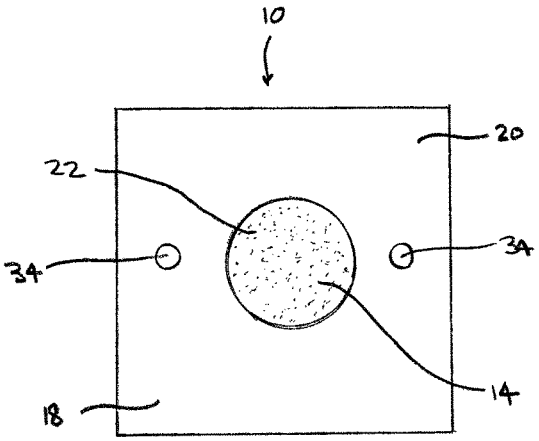
FIG. 10A is a plan view of the planar contact surface of a dielectric resonator component having an open aperture and two symmetrically placed unfilled holes outside of the open aperture.
Figure 10B:
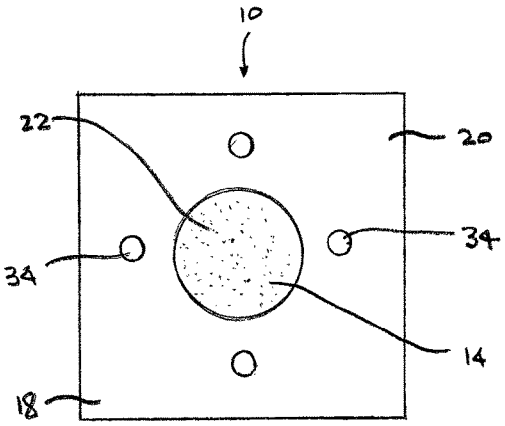
FIG. 10B is a plan view of the planar contact surface of a dielectric resonator component having an open aperture and four symmetrically placed unfilled holes outside of the open aperture.
Figure 10C:
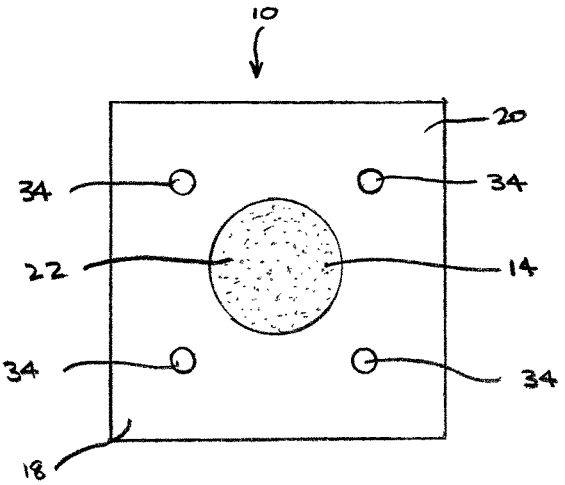
FIG. 10C is a plan view of the planar contact surface of a dielectric resonator component having an open aperture and four symmetrically placed unfilled holes outside of the open aperture at positions rotated by 45° relative to those shown in FIG. 10B.
Figure 10D:
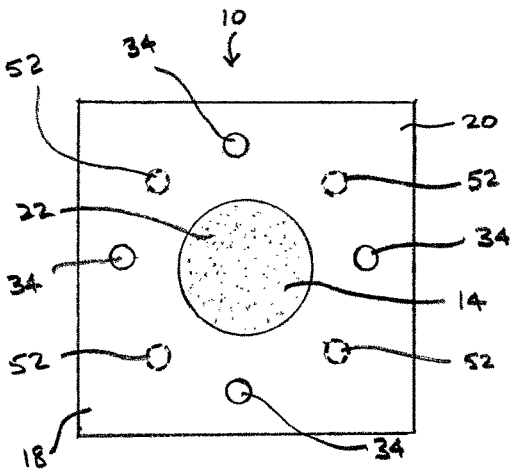
FIG. 10D is a plan view of the planar contact surface of a dielectric resonator component having an open aperture and four symmetrically placed unfilled holes outside of the open aperture, as shown in FIG. 10B, showing the offset positions of the four symmetrically placed unfilled holes shown in FIG. 10C.
Figure 10E:
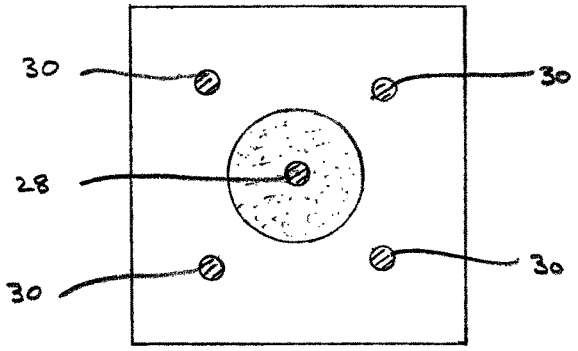
FIG. 10E is a plan view of the planar contact surface of a dielectric resonator component having an open aperture with a conductive-material filled hole and four symmetrically placed conductive-material filled holes outside of the open aperture.

Sometimes it will be desirable to maintain the symmetry of the fields inside the dielectric resonator components during the tuning process. This can be achieved by choosing an arrangement of symmetrically placed holes. FIGS. 10A to 10E show examples of such symmetrical arrangements. FIG. 10A shows two symmetrically placed unfilled holes; FIG. 10B shows four symmetrically placed unfilled holes; and FIG. 10C shows a similar arrangement of four unfilled holes rotated by 45° relative to the positions shown in FIG. 10B. The latter two arrangements could be useful if unfilled holes are required in both of the adjacent dielectric resonator components because it leaves the unfilled holes offset from one another to avoid undesired electric-field coupling from one dielectric resonator component to the next through aligned unfilled holes. Such an arrangement is shown in FIG. 10D, where unfilled holes in an adjacent dielectric resonator component are in the positions shown by phantom holes 52. When the unfilled holes 34 are offset in this way, they are capped by the conductive coating 18 on the adjacent dielectric resonator component. FIG. 10E shows an additional example where the four outer filled holes 30 are combined with a single central filled hole 30 in the open aperture 22. This combination allows both the electric-field coupling and the resonant frequency to be controlled in a manner similar to that described above for the pair of holes.

The exact arrangement of holes, filled or unfilled, to use in a specific situation will be determined by the required changes in resonant frequency and electric-field coupling, and also by other constraints in specific situations, such as a need to maintain symmetry. All of these possibilities can be considered to be combinations of the basic tuning operations discussed above, which utilize filled and unfilled holes either inside or outside the open or annular aperture.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. A pair of joined dielectric resonator components of an RF filter, said pair of joined dielectric resonator components comprising:

a first dielectric resonator component including a first block of dielectric material, said first block having a coating of a first conductive material and at least one planar face, said at least one planar face including a first aperture formed by removing said coating of first conductive material from a portion of said at least one planar face of said first block;

a second dielectric resonator component including a second block of dielectric material, said second block having a coating of a second conductive material and at least one planar face, said at least one planar face including a second aperture formed by removing said coating of second conductive material from a portion of said at least one planar face of said second block, wherein said first and second dielectric resonator components are joined to one another with said coating of first conductive material on said planar face of said first block in contact with said coating of second conductive material on said planar face of said second block, and with said first aperture aligned with said second aperture, and wherein said second dielectric resonator component has a hole through said coating of second conductive material and into said second block of dielectric material, said hole being outside of said second aperture, to control electric-field coupling between said first and second dielectric resonator components, and wherein said first aperture has a first central island of said first conductive material and said second aperture has a second central island of said second conductive material, said first central island being aligned with said second central island.

2. The pair of joined dielectric resonator components as claimed in claim 1, wherein said hole is not filled with any conductive material in order to increase electric-field coupling through the aligned first and second apertures.

3. The pair of joined dielectric resonator components as claimed in claim 2, wherein said hole is capped by said coating of first conductive material on said planar face of said first block.

4. The pair of joined dielectric resonator components as claimed in claim 1, wherein said hole is filled with any conductive material in order to decrease electric-field coupling through the aligned first and second apertures.

5. A pair of joined dielectric resonator components of an RF said pair of joined dielectric resonator components comprising:

a first dielectric resonator component including a first block of dielectric material, said first block having a coating of a first conductive material and at least one planar face, said at least one planar face including a first aperture formed by removing said coating of first conductive material from a portion of said at least one planar face of said first block;

a second dielectric resonator component including a second block of dielectric material, said second block having a coating of a second conductive material and at least one planar face, said at least one planar face including a second aperture formed by removing said coating of second conductive material from a portion of said at least one planar face of said second block, wherein said first and second dielectric resonator components are joined to one another with said coating of first conductive material on said planar face of said first block in contact with said coating of second conductive material on said planar face of said second block, and with said first aperture aligned with said second aperture, and wherein said second dielectric resonator component has a hole through said coating of second conductive material and into said second block of dielectric material, said hole being outside of said second aperture, to control electric-field coupling between said first and second dielectric resonator components, and wherein said second dielectric resonator component further has at least one additional hole through said coating of second conductive material and into said second block of dielectric material, said second hole being outside of said second aperture.

6. The pair of joined dielectric resonator components as claimed in claim 5, wherein said at least additional hole is not filled with any conductive material.

7. The pair of joined dielectric resonator components as claimed in claim 6, wherein said at least one additional hole is capped by said coating of said first conductive material on said planar face of said first block.

8. The pair of joined dielectric resonator components as claimed in claim 5, wherein said at least one additional hole is filled with any conductive material.

9. A pair of joined dielectric resonator components of an RF filter, said pair of joined dielectric resonator components comprising:

a first dielectric resonator component including a first block of dielectric material, said first block having a coating of a first conductive material and at least one planar face, said at least one planar face including a first aperture formed by removing said coating of first conductive material from a portion of said at least one planar face of said first block;

a second dielectric resonator component including a second block of dielectric material, said second block having a coating of a second conductive material and at least one planar face, said at least one planar face including a second aperture formed by removing said coating of second conductive material from a portion of said at least one planar face of said second block, wherein said first and second dielectric resonator components are joined to one another with said coating of first conductive material on said planar face of said first block in contact with said coating of second conductive material on said planar face of said second block, and with said first aperture aligned with said second aperture, and wherein said first aperture has a first central island of said first conductive material and said second aperture has a second central island of said second conductive material, said first central island being aligned with said second central island.

10. The pair of joined dielectric resonator components as claimed in claim 9, wherein said second aperture has a hole into said dielectric material of said second block in order to control electric-field coupling through the aligned first and second apertures.

11. The pair of joined dielectric resonator components as claimed in claim 10, wherein said hole is not filled with any conductive material in order to decrease electric-field coupling through the aligned first and second apertures.

12. The pair of joined dielectric resonator components as claimed in claim 10, wherein said hole is filled with any conductive material in order to increase electric-field coupling through the aligned first and second apertures.

13. The pair of joined dielectric resonator components as claimed in claim 9, wherein said second central island has a hole through said second conductive material and into said second block of dielectric material, said hole being filled with any conductive material in order to increase electric-field coupling through the aligned first and second apertures.

14. The pair of joined dielectric resonator components as claimed in claim 9, wherein said second central island has a hole through said second conductive material and into said second block of dielectric material, said hole not being filled with any conductive material in order to decrease electric-field coupling through the aligned first and second apertures.

15. The dielectric resonator as claimed in claim 14, wherein said hole is capped by said coating of said first conductive material of said first central island in said first aperture of said first dielectric resonator component.

16. A pair of joined dielectric resonator components of an RF filter, said pair of joined dielectric resonator components comprising:

a first dielectric resonator component including a first block of dielectric material, said first block having a coating of a first conductive material and at least one planar face, said at least one planar face including a first aperture formed by removing said coating of first conductive material from a portion of said at least one planar face of said first block;

a second dielectric resonator component including a second block of dielectric material, said second block having a coating of a second conductive material and at least one planar face, said at least one planar face including a second aperture formed by removing said coating of second conductive material from a portion of said at least one planar face of said second block, wherein said first and second dielectric resonator components are joined to one another with said coating of first conductive material on said planar face of said first block in contact with said coating of second conductive material on said planar face of said second block, and with said first aperture aligned with said second aperture, wherein said second aperture has a hole into said dielectric material of said second block in order to control electric-field coupling through the aligned first and second apertures, wherein said hole is filled with any conductive material in order to increase electric-field coupling through the aligned first and second apertures, and wherein said second dielectric resonator component further has at least one additional hole through said coating of second conductive material and into said second block of dielectric material, said second hole being outside of said second aperture.

17. The pair of joined dielectric resonator components as claimed in claim 16, wherein said at least one additional hole is filled with any conductive material.

18. The pair of joined dielectric resonator components as claimed in claim 16, wherein said at least additional hole is not filled with any conductive material.

19. The pair of joined dielectric resonator components as claimed in claim 18, wherein said at least one additional hole is capped by said coating of said first conductive material on said planar face of said first block.

20. A pair of joined dielectric resonator components of an RF filter, said pair of joined dielectric resonator components comprising:

a first dielectric resonator component including a first block of dielectric material, said first block having a coating of a first conductive material and at least one planar face, said at least one planar face including a first aperture formed by removing said coating of first conductive material from a portion of said at least one planar face of said first block;

a second dielectric resonator component including a second block of dielectric material, said second block having a coating of a second conductive material and at least one planar face, said at least one planar face including a second aperture formed by removing said coating of second conductive material from a portion of said at least one planar face of said second block, wherein said first and second dielectric resonator components are joined to one another with said coating of first conductive material on said planar face of said first block in contact with said coating of second conductive material on said planar face of said second block, and with said first aperture aligned with said second aperture, wherein said second aperture has a hole into said dielectric material of said second block in order to control electric-field coupling through the aligned first and second apertures, wherein said hole is not filled with any conductive material in order to decrease electric-field coupling through the aligned first and second apertures, and wherein said second dielectric resonator component further has at least one additional hole through said coating of second conductive material and into said second block of dielectric material, said second hole being outside of said second aperture.

21. The pair of joined dielectric resonator components as claimed in claim 20, wherein said at least one additional hole is filled with any conductive material.

22. The pair of joined dielectric resonator components as claimed in claim 20, wherein said at least additional hole is not filled with any conductive material.

23. The pair of joined dielectric resonator components as claimed in claim 22, wherein said at least one additional hole is capped by said coating of said first conductive material on said planar face of said first block.

* * * * *